US006129640A

United States Patent [19]

Higuchi et al.

[11] Patent Number: 6,129,640

[45] Date of Patent: Oct. 10, 2000

[54] MULTI-PIECE SOLID GOLF BALL

[75] Inventors: Hiroshi Higuchi; Yasushi Ichikawa; Hisashi Yamagishi, all of Chichibu, Japan

[73] Assignee: Bridgestone Sports Co., Ltd., Tokyo, Japan

[21] Appl. No.: 09/268,663

[22] Filed: Mar. 16, 1999

[30] Foreign Application Priority Data

Mar. 16, 1998 [JP] Japan ..... 10-085025

[51] Int. Cl.[7] ..... A63B 37/06

[52] U.S. Cl. ..... 473/374

[58] Field of Search ..... 473/351, 374, 473/376

[56] References Cited

U.S. PATENT DOCUMENTS

| | | | |
|---|---|---|---|
| 4,714,253 | 12/1987 | Nakahara et al. . | |
| 5,184,828 | 2/1993 | Kim et al. | 473/374 |
| 5,704,854 | 1/1998 | Higuchi et al. | 473/374 X |
| 5,730,664 | 3/1998 | Asakura et al. | 473/374 X |
| 5,820,487 | 10/1998 | Nakamura et al. | 473/374 |
| 5,830,085 | 11/1998 | Higuchi et al. | 473/374 X |
| 5,899,822 | 5/1999 | Yamagishi et al. | 473/374 |
| 5,957,784 | 9/1999 | Asakura et al. | 473/374 |
| 5,967,907 | 10/1999 | Takemura et al. | 473/374 X |
| 5,967,908 | 10/1999 | Yamagishi et al. | 473/374 X |
| 5,980,396 | 11/1999 | Moriyama et al. | 473/376 |

FOREIGN PATENT DOCUMENTS

| | | |
|---|---|---|
| 4-244174 | 9/1992 | Japan . |
| 6-142228 | 5/1994 | Japan . |
| 2 320 440 | 6/1998 | United Kingdom . |

*Primary Examiner*—John A. Ricci
*Attorney, Agent, or Firm*—Sughrue, Mion, Zinn, Macpeak & Seas, PLLC

[57] ABSTRACT

In a multi-piece solid golf ball comprising a solid core, an intermediate layer, and a cover, the solid core has a diameter of 28–40 mm and a specific gravity of less than 1.3, the intermediate layer is formed mainly of a polyurethane resin and has a Shore D hardness of 25–50 and a specific gravity of 1.1–2.0 and greater than that of the solid core, and the cover is formed mainly of an ionomer resin and has a gage of 0.5–3.2 mm and a Shore D hardness of 45–68. The golf ball offers a satisfactory flight distance and soft feel and is improved in spin properties.

18 Claims, No Drawings

MULTI-PIECE SOLID GOLF BALL

BACKGROUND OF THE INVENTION

1. Field of the Invention

This invention relates to a multi-piece solid golf ball having satisfactory flight performance, spin properties and feel.

2. Prior Art

Golf balls having a variety of constructions are available on the market. Of these, the majority of golf balls now on the market are two-piece solid golf balls having a rubber-based core enclosed within a cover made of ionomer resin or the like, and thread-wound golf balls comprising a solid or liquid center about which is wound a rubber thread which is in turn enclosed within a cover.

Most golfers of ordinary skill use two-piece solid golf balls because of their excellent flight performance and durability. However, the two-piece solid golf balls have a very hard feel when hit, and are difficult to control because of the rapid separation of the ball from the head of the club. For this reason and others, many professional golfers and low-handicap golfers prefer thread-wound golf balls to two-piece solid golf balls. Although thread-wound golf balls have a superior feel and controllability, their flight distance and durability fall short of those for two-piece solid golf balls.

Since two-piece solid golf balls and thread-wound golf balls today provide mutually opposing features, golfers select which type of ball to use based on their level of skill and personal preference.

This situation has prompted efforts to approximate the feel of a thread-wound golf ball in a solid golf ball. As a result, a number of soft, two-piece solid golf balls have been proposed. A soft core is used to obtain such soft two-piece solid golf balls, but making the core softer lowers the resilience of the golf ball, compromises flight performance, and also markedly reduces durability. As a result, not only do these balls lack the excellent flight performance and durability characteristic of ordinary two-piece solid golf balls, but they are often in fact unfit for actual use. More specifically, the structure of prior art two-piece solid golf balls is determined depending on which of the three features of softness, resilience, and durability is more important. Any attempt to improve one of these features compromises the remaining features.

A variety of three-piece solid golf balls having an intermediate layer interposed between the core and the cover were recently proposed. For example, JP-A 142228/1994 and 244174/1992 disclose intermediate layers of polyester resin and polyamide resin, respectively. They cannot fully meet the requirements of flight distance, feel, and spin properties (especially spin properties upon short iron shots) at the same time.

Therefore, there is a desire to have a golf ball which gives a soft pleasant feel when hit and remains durable, which receives relatively less spin when hit with a wood or long iron club, but maintains initial spin during flight so that an increased carry is available with good controllability, and which offers satisfactory spin properties when hit with a short iron club.

SUMMARY OF THE INVENTION

An object of the present invention is to provide a multi-piece solid golf ball which is improved in total balance in that spin properties and feel are improved without detracting from the excellent flight performance and durability characteristic of solid golf balls.

The invention pertains to a solid golf ball comprising at least three layers including a solid core (or center core), an intermediate layer, and a cover. The inventors have found that by forming the intermediate layer mainly from a polyurethane resin having a Shore D hardness of 25 to 50 and a specific gravity greater than that of the solid core for thereby increasing the moment of inertia, and by forming the cover from an ionomer resin to the desired gage and hardness, the ball is given satisfactory flight distance properties and soft feel, and improved in spin properties in that it receives a relatively less spin when hit with a wood or long iron club, but an appropriate spin when hit with a short iron club.

Specifically, the invention provides a multi-piece solid golf ball comprising a solid core, an intermediate layer, and a cover, wherein (a) the solid core has a diameter of at least 28 mm and a specific gravity of less than 1.3, (b) the intermediate layer is formed mainly of a polyurethane resin and has a Shore D hardness of 25 to 50 and a specific gravity of at least 1.1 and greater than that of the solid core, (c) the cover is formed mainly of an ionomer resin and has a gage of 0.5 to 3.2 mm and a Shore D hardness of 45 to 68.

DETAILED DESCRIPTION OF THE INVENTION

The multi-piece solid golf ball of the invention includes a solid core or center core becoming the center of the ball, a cover becoming the outermost layer of the ball, and a relatively heavy intermediate layer between the core and the cover formed mainly of a polyurethane resin.

The solid core may be formed of a rubber composition comprising a base rubber, co-crosslinking agent, peroxide, and other additives. The core is typically formed by molding the rubber composition under heat and pressure.

The base rubber may be natural and/or synthetic rubber commonly used in prior art solid golf balls although 1,4-polybutadiene containing at least 40%, especially at least 90% of cis-structure is preferable. Another rubber component such as natural rubber, polyisoprene rubber or styrene-butadiene rubber may be blended with the polybutadiene rubber if desired. For high resilience, the base rubber should preferably contain at least 90% by weight of 1,4-polybutadiene having at least 90% of cis-structure.

In conventional solid golf balls, zinc and magnesium salts of unsaturated fatty acids such as methacrylic acid and acrylic acid and esters such as trimethylpropane trimethacrylate are used as the co-crosslinking agent. These compounds may be used herein although zinc acrylate is preferred because it can impart high resilience. The co-crosslinking agent is preferably used in an amount of about 10 to 30 parts by weight per 100 parts by weight of the base rubber.

Various peroxides are useful although dicumyl peroxide or a mixture of dicumyl peroxide and 1,1-bis(t-butylperoxy)-3,3,5-trimethylcyclohexane is appropriate. The amount of the peroxide blended is preferably about 0.5 to 1 part by weight per 100 parts by weight of the base rubber.

In the rubber composition, zinc oxide or barium sulfate are blended if necessary for adjusting the specific gravity. Anti-oxidants and other additives are also blended therein if desired.

In preparing the solid core from the rubber composition, the above-mentioned components are kneaded in a conventional mixer such as a kneader, Banbury mixer or roll mill, placed in a mold, and molded under appropriate heat and pressure, preferably at 145 to 160° C.

Preferably, the solid core should have such a hardness that the core experiences a deflection of 3.2 to 5.2 mm under a load varying from an initial load of 10 kg to a final load of 130 kg. This deflection is defined as a deflection under a final load of 130 kg minus a deflection under an initial load of 10 kg and is simply designated a deflection under a load of 10–130 kg. The deflection under a load of 10–130 kg is more preferably 3.5 to 5.0 mm, most preferably 3.8 to 4.8 mm. If this deflection is less than 3.2 mm, suggesting that the core is too hard, then the feel of the ball when hit would become hard. If the deflection is more than 5.2 mm, suggesting that the core is too soft, then the ball would sometimes become less durable and less resilient, leading to poor flight performance.

Further preferably, the core at the surface has a Shore D hardness of 30 to 55, more preferably 35 to 52, most preferably 44 to 50. When Shore D hardness is randomly measured in a cross section of the core, the difference in hardness between any two positions should preferably be no more than 10 Shore D units, more preferably no more than 6 Shore D units.

The solid core has a diameter of at least 28 mm, preferably 30 to 40 mm, more preferably 32 to 38 mm, and most preferably 34 to 37 mm. The core has a specific gravity of less than 1.3, preferably 1.0 to 1.28, more preferably 1.05 to 1.25.

Most often, the core is formed to a one-piece structure consisting of a single layer although it may be formed to a multilayer structure of two or more layers if desired.

In the golf ball of the invention, the intermediate layer is formed mainly of a polyurethane resin. Thermoplastic polyurethane elastomers are appropriate as the polyurethane resin.

The thermoplastic polyurethane elastomer has a molecular structure including soft segments of a high molecular weight polyol, hard segments constructed of a monomolecular chain extender, and a diisocyanate.

The high molecular weight polyol compound is not critical and may be any of polyester polyols, polyol polyols, copolyester polyols, polycarbonate polyols and polyether polyols. The polyester polyols include polycaprolactone glycol, poly(ethylene-1,4-adipate) glycol, and poly (butylene-1,4-adipate) glycol. Typical of the copolyester polyols is poly(diethylene glycol adipate) glycol. One exemplary polycarbonate polyol is hexane diol-1,6-carbonate glycol. Polyoxytetramethylene glycol is typical of the polyether polyols. These polyols have a number average molecular weight of about 600 to 5,000, preferably about 1,000 to 3,000.

The diisocyanates used herein include hexamethylene diisocyanate (HDI), tolylene diisocyanate (TDI), diphenylmethane diisocyanate (MDI), hydrogenated MDI ($H_{12}$MDI), IPDI, CHDI, and derivatives thereof.

The chain extender used herein is not critical and may be any of commonly used polyhydric alcohols and amines. Examples include 1,4-butylene glycol, 1,2-ethylene glycol, 1,3-propylene glycol, 1,6-hexylene glycol, 1,3-butylene glycol, dicyclohexylmethane diamine (hydrogenated MDA), and isophorone diamine (IPDA).

The intermediate layer according to the invention is formed mainly of the polyurethane resin, especially thermoplastic polyurethane elastomer, with which another thermoplastic resin may be blended if desired for enhancing the effect and benefits of the invention. Examples of the other thermoplastic resin which can be blended include polyamide elastomers, polyester elastomers, ionomer resins, styrene block elastomers, hydrogenated polybutadiene, ethylene-vinyl acetate (EVA) copolymers, polycarbonates, polyacrylates, and polyamides.

According to the invention, the intermediate layer is formed to a Shore D hardness of 20 to 50, preferably 23 to 50, more preferably 28 to 40, most preferably 32 to 38. With a Shore D hardness of less than 20, the ball becomes less resilient or less durable. A Shore D hardness of more than 50 adversely affects the feel of the ball when hit and the resilience.

The intermediate layer is preferably made softer than the solid core. It is recommended that the Shore D hardness of the intermediate layer is lower than the surface hardness of the core by at least 6 Shore D units, more preferably by 8 to 15 Shore D units. The intermediate layer made softer than the solid core ensures that the ball has a soft feel and specifically, a soft, but not too soft, appropriate feel with click.

The intermediate layer is formed to a specific gravity of at least 1.1, preferably 1.15 to 2.0, more preferably 1.2 to 1.5, most preferably 1.22 to 1.4. The specific gravity of the intermediate layer is greater than that of the solid core. Desirably, the specific gravity of the intermediate layer is greater than that of the solid core by at least 0.05, especially 0.08 to 0.15. Then, the moment of inertia of the ball is maintained so large that the attenuation of spin rate of the ball during flight may be minimized. The spin rate acquired immediately after a club shot is retained or slightly attenuated until the ball falls and lands. The ball can maintain stable flight until the ball lands on the ground.

To form the intermediate layer to a specific gravity within the above-defined range, an inorganic filler, especially a filler having a specific gravity of at least 3 may be blended in the polyurethane resin. Exemplary inorganic fillers are metal powder, metal oxides, metal nitrides, and metal carbides. Illustrative examples include tungsten (black, specific gravity 19.3), tungsten carbide (blackish brown, specific gravity 15.8), molybdenum (gray, specific gravity 10.2), lead (gray, specific gravity 11.3), lead oxide (dark gray, specific gravity 9.3), nickel (silvery gray, specific gravity 8.9), copper (reddish brown, specific gravity 8.9), and mixtures thereof. It is preferred to use such high specific gravity fillers although fillers having a relatively low specific gravity such as barium sulfate, titanium dioxide, and zinc white may be used.

The gage or thickness of the intermediate layer may be determined as appropriate although it is preferably 0.2 to 3.0 mm, more preferably 0.5 to 2.5 mm thick.

Preferably a sphere consisting of the solid core and the intermediate layer experiences a deflection of 3.2 to 5.2 mm under a load of 10–130 kg (the deflection under a load of 10–130 kg is defined as a deflection under a final load of 130 kg minus a deflection under an initial load of 10 kg). Then the ball offers a good feeling and flight distance.

Around the intermediate layer, the cover is formed to complete the golf ball of the invention. The cover may be formed mainly of an ionomer resin which is commonly used in conventional solid golf balls. Exemplary cover stocks which can be used herein include Himilan 1605 and 1706 by Du Pont-Mitsui Polychemicals Co., Ltd. and Surlyn 8120 and 8320 by E. I. duPont. A combination of two or more ionomer resins may also be used. If desired, the ionomer resin may be blended with well-known additives such as pigments, dispersants, antioxidants, UV-absorbers, UV-stabilizers, and plasticizers.

According to the invention, the cover is formed to a Shore D hardness of 45 to 68, preferably 50 to 67, more preferably 55 to 65. With a cover hardness of less than 45 in Shore D, the ball becomes less resilient or more susceptible to spin. A Shore D hardness of more than 68 adversely affects the durability of the ball and feel upon putting.

The cover has a gage of 0.5 to 3.2 mm, preferably 1.0 to 2.5 mm, more preferably 1.2 to 2.2 mm. With a cover gage of less than 0.5 mm, the ball is less durable and sometimes less resilient. A cover gage of more than 3.2 mm adversely affects feel.

The cover may be formed to either a single layer or a multilayer structure of two or more layers.

Since the intermediate layer is formed of a composition based on the thermoplastic polyurethane elastomer, the composition can be molded over the solid core by compression molding or injection molding.

On the other hand, the cover is formed of a cover stock based on the ionomer resin. The method of enclosing the intermediate layer with the cover is not particularly limited. Most often, a pair of hemispherical cups are preformed from the cover stock, the intermediate layer is wrapped with the pair of cups, and molding is effected under heat and pressure. Alternatively, the cover stock is injection molded over the intermediate layer.

The golf ball of the invention is formed with a multiplicity of dimples in the cover surface. The geometrical arrangement of dimples may be octahedral, icosahedral or the like while the dimple pattern may be selected from square, hexagon, pentagon, and triangle patterns.

While the above construction is met, the solid golf ball of the invention may be formed so as to have a diameter of not less than 42.67 mm and a weight of not greater than 45.93 g in accordance with the Rules of Golf. The golf ball in its entirety preferably has a moment of inertia of 81 to 86 g.cm$^2$, especially 82 to 85 g.cm$^2$, as measured under the conditions described in Example.

The multi-piece solid golf ball of the invention offers a satisfactory flight distance and soft feel and is improved in spin properties.

EXAMPLE

Examples of the invention are given below by way of illustration and not by way of limitation.

Examples 1–5 & Comparative Examples 1–4

On a solid core of the composition shown in Table 1, the composition shown in Table 2 was injection molded to form an intermediate layer. The cover stock of the composition shown in Table 3 was injection molded thereon to form a cover. In this way, three-piece solid golf balls with the parameters shown in Table 4 were fabricated.

The golf balls were examined for moment of inertia, flight distance, spin rate, feel, scraping resistance, and consecutive durability by the following tests.

Scraping resistance

Using a swing robot, the ball was hit at two points with a sand wedge at a head speed of 38 m/sec. The ball at the hit points was visually examined.

0: good

Δ: medium

X: poor

Consecutive durability

Using a flywheel hitting machine, the ball was repeatedly hit at a head speed of 38 m/sec. The ball was evaluated in terms of the number of hits repeated until the ball was broken.

0: good

Δ: medium

X: poor

Moment of Inertia

It is calculated according to the equation shown below. More particularly, the moment of inertia is a value calculated from the diameters (gages) and specific gravities of the respective layers and it can be determined from the following equation on the assumption that the ball is spherical. Although the ball is regarded spherical for the calculation purpose, the specific gravity of the cover is lower than the specific gravity of the cover stock itself because the dimples are present on the actual ball. The specific gravity of the cover is herein designated an imaginary cover specific gravity, which is used for the calculation of the moment of inertia M.

$$M=(\pi/5880000)\times\{(r1-r2)\times D1^5+(r2-r3)\times D2^5+r3\times D3^5\}$$

M: moment of inertia (g-cm$^2$)

r1: core specific gravity

D1: core diameter r2: intermediate layer specific gravity

D2: intermediate layer diameter (the diameter of a sphere obtained by forming the intermediate layer around the core)

r3: imaginary cover specific gravity

D3: cover diameter (ball diameter)

Note that the diameters are expressed in mm.

Flight distance

Using the swing robot, the ball was hit with a driver (W#1) at a head speed of 45 m/sec to measure a carry and total distance.

Spin rate

A spin rate was calculated from photographic analysis by photographing the behavior of the ball immediately after impact with W#1 and No. 9 iron (I#9, head speed 36 m/sec.).

Feeling

Three professional golfers actually hit the ball with W#1 and I#9 to examine the ball for feeling according to the following criteria.

0: soft

Δ: somewhat hard

X: hard

The results are shown in Table 4.

TABLE 1

| | Solid core composition (pbw) | | | | | | | | |
|---|---|---|---|---|---|---|---|---|---|
| | Example | | | | | Comparative Example | | | |
| | 1 | 2 | 3 | 4 | 5 | 1 | 2 | 3 | 4 |
| Polybutadiene | 100 | 100 | 100 | 100 | 100 | 100 | 100 | 100 | 100 |
| Dicumyl peroxide | 1.2 | 1.2 | 1.2 | 1.2 | 1.2 | 1.2 | 1.2 | 1.2 | 1.2 |
| Barium sulfate | 7.6 | 10.5 | 8.3 | 3.3 | 13.6 | 18.9 | 21.1 | 12.8 | 20.6 |
| Zinc white | 5 | 5 | 5 | 5 | 5 | 5 | 5 | 5 | 5 |
| Antioxidant | 0.2 | 0.2 | 0.2 | 0.2 | 0.2 | 0.2 | 0.2 | 0.2 | 0.2 |
| Zinc salt of pentachlorothiophenol | 1 | 1 | 1 | 1 | 1 | 1 | 1 | 1 | |
| Zinc acrylate | 29.6 | 24.8 | 28.1 | 24.8 | 26.3 | 33.3 | 25.9 | 34.0 | 34.0 |

Note: Polybutadiene is BR01 by Nippon Synthetic Rubber K.K.

TABLE 2

| | Intermediate layer composition (pbw) | | | | | | | | |
|---|---|---|---|---|---|---|---|---|---|
| | Shore D | a | b | c | d | e | f | g | h |
| Pandex T1190 | 40 | 100 | — | 100 | — | — | — | — | — |
| Pandex T1180 | 30 | — | 100 | — | 100 | 100 | — | — | — |
| Hytrel 4047 | 40 | — | — | — | — | — | — | 100 | — |
| PEBAX 3533 | 42 | — | — | — | — | — | 100 | — | — |
| Himilan 1706 | 63 | — | — | — | — | — | — | — | 60 |
| Surlyn 8120 | 45 | — | — | — | — | — | — | — | 40 |
| Titanium dioxide | — | — | — | 6 | 20 | — | — | — | — |
| Tungsten | — | 4.5 | 14.5 | — | — | 4.5 | — | — | - |

Note:
Pandex T1190 and T1180 are polyurethane elastomers by Dai-Nippon Ink & Chemical Industry K.K.
Hytrel 4047 is a polyester elastomer by Toray-duPont K.K.
PEBAX 3533 is a polyamide elastomer by Toray K.K.
Himilan 1706 is an ionomer resin by Du Pont-Mitsui Polychemicals Co., Ltd.
Surlyn 8120 is an ionomer resin by E. I. duPont.

TABLE 3

| | Cover Composition (pbw) | | | | | |
|---|---|---|---|---|---|---|
| | Shore D | A | B | C | D | E |
| Himilan 1605 | 63 | — | 50 | — | — | — |
| Himilan 1706 | 63 | 55 | 50 | — | 40 | 70 |
| Surlyn 8120 | 45 | 45 | — | 100 | 60 | 30 |
| Titanium dioxide | — | 5.13 | 5.13 | 5.13 | 5.13 | 5.13 |

Note:
Himilan 1605 and 1706 are ionomer resins by Du Pont-Mitsui Polychemicals Co., Ltd.
Surlyn 8120 is an ionomer resin by E. I. duPont.

TABLE 4

| | | E1 | E2 | E3 | E4 | E5 | CE1 | CE2 | CE3 | CE4 |
|---|---|---|---|---|---|---|---|---|---|---|
| Core | Weight (g) | 27.52 | 27.62 | 27.52 | 26.60 | 26.54 | 30.25 | 27.47 | 29.72 | 30.76 |
| | Outer diameter (mm) | 36.00 | 36.00 | 36.00 | 36.00 | 35.30 | 36.40 | 35.30 | 36.50 | 36.50 |
| | Deflection under 10–130 kg (mm) | 3.65 | 4.15 | 3.70 | 4.15 | 3.95 | 3.00 | 4.00 | 2.90 | 2.90 |
| | Surface hardness (Shore D) | 50 | 48 | 50 | 48 | 49 | 54 | 48 | 55 | 55 |
| | Specific gravity | 1.127 | 1.131 | 1.127 | 1.089 | 1.152 | 1.198 | 1.193 | 1.167 | 1.208 |
| Inter-mediate layer | Type | a | b | c | d | e | f | g | g | h |
| | Hardness (Shore D) | 43 | 35 | 43 | 35 | 35 | 42 | 40 | 40 | 56 |
| | Weight* (g) | 37.86 | 35.61 | 37.86 | 37.86 | 35.61 | 38.59 | 35.66 | 37.90 | 37.90 |

TABLE 4-continued

| | | E1 | E2 | E3 | E4 | E5 | CE1 | CE2 | CE3 | CE4 |
|---|---|---|---|---|---|---|---|---|---|---|
| | Outer diameter* (mm) | 39.70 | 38.70 | 39.70 | 39.70 | 38.70 | 40.00 | 38.70 | 39.70 | 39.70 |
| | Specific gravity | 1.24 | 1.35 | 1.24 | 1.35 | 1.24 | 1.01 | 1.12 | 1.12 | 0.98 |
| | Gage (mm) | 1.85 | 1.35 | 1.85 | 1.85 | 1.70 | 1.80 | 1.70 | 1.60 | 1.60 |
| Cover | Type | A | B | A | B | B | C | B | D | E |
| | Specific gravity | 0.98 | 0.98 | 0.98 | 0.98 | 0.98 | 0.98 | 0.98 | 0.98 | 0.98 |
| | Gage (mm) | 1.50 | 2.00 | 1.50 | 1.50 | 2.00 | 1.35 | 2.00 | 1.50 | 1.50 |
| | Hardness (Shore D) | 55 | 63 | 55 | 63 | 63 | 45 | 63 | 53 | 58 |
| Ball | Weight (g) | 45.3 | 45..3 | 45.3 | 45.3 | 45.3 | 45.3 | 45.3 | 45.3 | 45.3 |
| | Outer diameter (mm) | 42.7 | 42.7 | 42.7 | 42.7 | 42.7 | 42.7 | 42.7 | 42.7 | 42.7 |
| Moment of Inertia ($g \cdot cm^2$) | | 83.2 | 82.9 | 83.2 | 84.3 | 82.3 | 81.2 | 81.3 | 82.1 | 80.9 |
| W#1/HS45 | Carry (m) | 208.8 | 209.0 | 208.8 | 228.7 | 229.0 | 205.9 | 207.9 | 205.8 | 207.9 |
| | Total (m) | 222.5 | 223.5 | 222.3 | 223.0 | 223.3 | 217.5 | 221.0 | 218.1 | 219.2 |
| | Spin (rpm) | 2702 | 2565 | 2651 | 2499 | 2528 | 3001 | 2548 | 2898 | 2689 |
| | Feeling | ○ | ○ | ○ | ○ | ○ | Δ | ○ | Δ | ○ |
| I#9/HS36 | Spin (rpm) | 9076 | 8902 | 9064 | 8838 | 8876 | 9343 | 8335 | 8935 | 8566 |
| | Feeling | ○ | ○ | ○ | ○ | ○ | Δ | ○ | ○ | ○ |
| Scraping resistance | | ○ | ○ | ○ | ○ | ○ | Δ | ○ | Δ | Δ |
| Consecutive durability | | ○ | Δ | ○ | Δ | Δ | ○ | Δ | ○ | ○ |

*core + intermediate layer

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A multi-piece solid golf ball comprising a solid core, an intermediate layer, and a cover, wherein said solid core has a diameter of at least 28 mm and a specific gravity of less than 1.3, said intermediate layer is formed mainly of a polyurethane resin and has a Shore D hardness of 25 to 50 and a specific gravity of at least 1.1 and greater than that of said solid core, and said cover is formed mainly of an ionomer resin and has a gage of 0.5 to 3.2 mm and a Shore D hardness of 45 to 68.

2. The golf ball of claim 1 wherein the Shore D hardness of said intermediate layer is lower than the surface hardness of said core by at least 6 Shore D units.

3. The golf ball of claim 1 wherein a sphere consisting of the solid core and the intermediate layer experiences a deflection of 3.2 to 5.2 mm under a load varying from an initial load of 10 kg to a final load of 130 kg.

4. The golf ball of claim 1 wherein said intermediate layer is formed from a composition comprising a polyurethane resin and an inorganic filler having a specific gravity of at least 3 such that the specific gravity of said intermediate layer is greater than that of said solid core by at least 0.05.

5. The golf ball of claim 1, wherein said core has a difference in Shore D hardness of not more than 10 between any two random positions in a cross section of the core.

6. The golf ball of claim 1, wherein said core has a difference in Shore D hardness of not more than 6 between any two random positions in a cross section of the core.

7. The golf ball of claim 1, wherein said intermediate layer formed mainly of the polyurethane resin further includes at least one resin selected from polyamide elastomers, polyester elastomers, ionmer resins, styrene block elastomers, hydrogenated polybutadiene, ethylene-vinyl acetate (EVA) copolymers, polycarbonates and polyacrylates.

8. The golf ball of claim 1, wherein said cover has a Shore D hardness of 50 to 65.

9. The golf ball of claim 1, wherein said core has a hardness corresponding to a deflection of 3.2 to 5.2 mm under an applied load varying from an initial load of 10 kg to a final load of 130 kg.

10. The golf ball of claim 1, wherein said solid core has a Shore D hardness in the range of 30 to 55.

11. The golf ball of claim 1, wherein said solid core has a diameter in the range of 30 to 40 mm.

12. The golf ball of claim 1, wherein said solid core has a specific gravity in the range of 1.0 to 1.28.

13. The golf ball of claim 1, wherein said core has a hardness corresponding to at least 3.95 mm under an applied initial load of 10 kg to a final load of 130 kg.

14. The golf ball of claim 1, wherein the Shore D hardness of said intermediate layer is lower than the surface hardness of said core by 8 to 15 Shore D units.

15. The golf ball of claim 1, wherein the specific gravity of said intermediate layer is greater than that of said solid core by 0.08 to 0.15.

16. The golf ball of claim 1, wherein said intermediate layer has a gage in the range of 0.2 to 3.0 mm.

17. The golf ball of claim 1, wherein said cover has a Shore D hardness in the range of 55 to 65.

18. The golf ball of claim 1, wherein said cover has a thickness in the range of 1.2 to 2.2 mm.

* * * * *